US008535012B2

(12) United States Patent
Schlosser et al.

(10) Patent No.: US 8,535,012 B2
(45) Date of Patent: Sep. 17, 2013

(54) ARRANGEMENT FOR AXIALLY SECURING BLADES IN A ROTOR OF A GAS TURBINE

(75) Inventors: Reimund Schlosser, Luxembourg (LU); Adam Zimmermann, Müheim a.d. Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 456 days.

(21) Appl. No.: 12/866,072

(22) PCT Filed: Jan. 14, 2009

(86) PCT No.: PCT/EP2009/050363

§ 371 (c)(1),
(2), (4) Date: Aug. 4, 2010

(87) PCT Pub. No.: WO2009/098111

PCT Pub. Date: Aug. 13, 2009

(65) Prior Publication Data

US 2011/0020125 A1 Jan. 27, 2011

(30) Foreign Application Priority Data

Feb. 8, 2008 (EP) ..... 08002388

(51) Int. Cl.
*F01D 5/30* (2006.01)

(52) U.S. Cl.
USPC ..... 416/220 R; 416/204 A

(58) Field of Classification Search
USPC ..... 416/220 R, 221, 219 A, 204 R, 204 A, 416/219 R
See application file for complete search history.

(56) References Cited

U.S. PATENT DOCUMENTS 2,641,443 A * 6/1953 Comery et al. ..... 416/221
5,518,369 A * 5/1996 Modafferi ..... 416/193 A

FOREIGN PATENT DOCUMENTS

| | | | |
|---|---|---|---|
| DE | 102004030965 | A1 | 2/2006 |
| EP | 0258754 | A2 | 3/1988 |
| FR | 2715968 | A1 | 8/1995 |
| JP | 61129405 | A | 6/1986 |
| JP | 1069702 | A | 3/1989 |
| JP | 2007120460 | A | 5/2007 |
| WO | WO 02066844 | A1 | 8/2002 |
| WO | WO 2007028703 | A1 | 3/2007 |

OTHER PUBLICATIONS

Translation of Glueck (DE 102004030965A1) provided by Espacenet.*
Translation of Brillert (WO 2007028703A) provided by Espacement.*

* cited by examiner

*Primary Examiner* — Edward Look
*Assistant Examiner* — Justin Seabe

(57) ABSTRACT

An arrangement for axially securing blades of a rotor of a gas turbine is provided. The arrangement includes a sealing element arranged on the end side surface of the rotor, which may be particularly reliably attached to the rotor by means of a sheet metal strip, the sheet metal strip including a shape-memory alloy.

3 Claims, 5 Drawing Sheets

FIG 3
FIG 3A
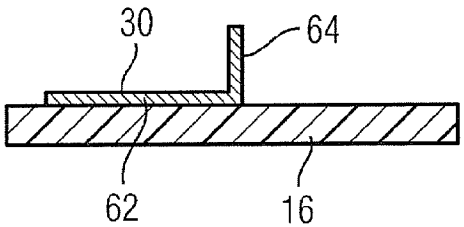
FIG 3B
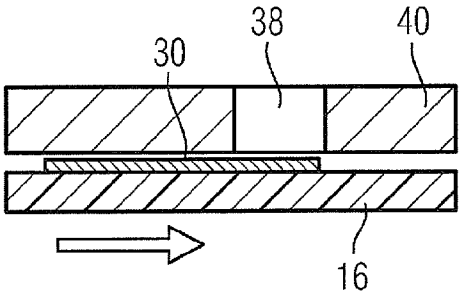
FIG 3C
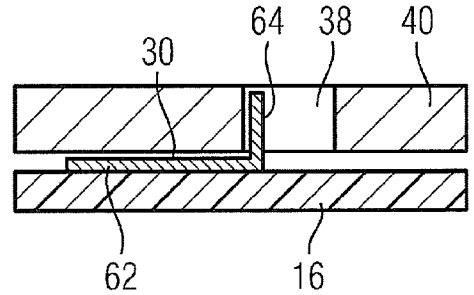
FIG 4
FIG 4A
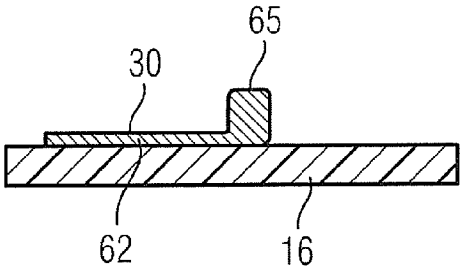
FIG 4B
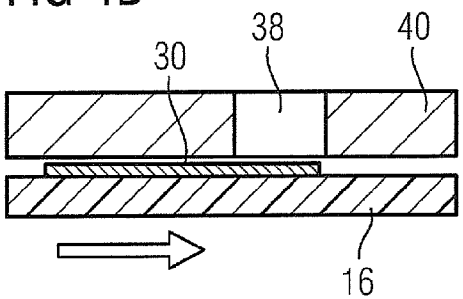
FIG 4C
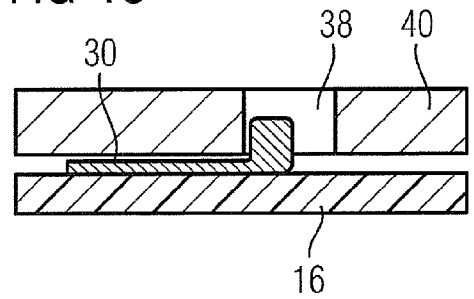

FIG 5
FIG 5A
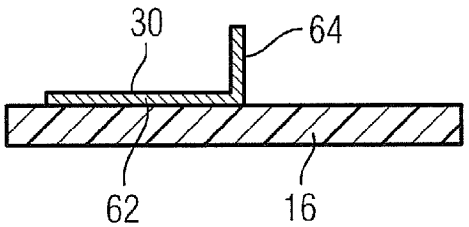
FIG 5B
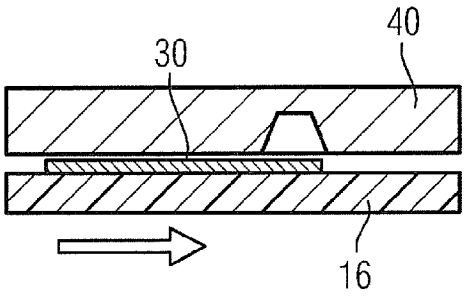
FIG 5C
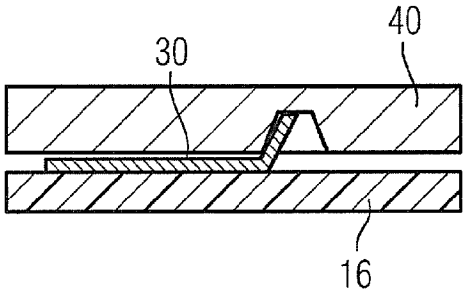
FIG 6
FIG 6A
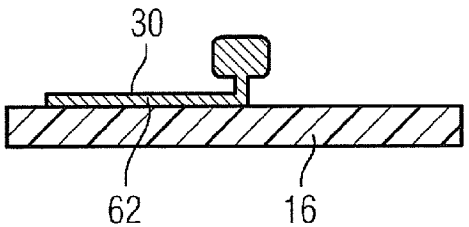
FIG 6B
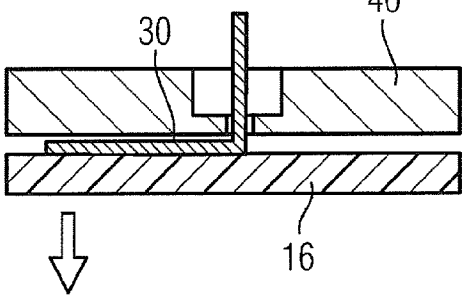
FIG 6C
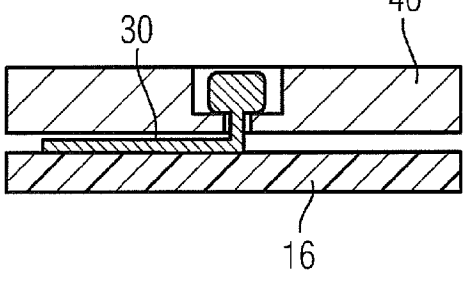

FIG 7
FIG 7A
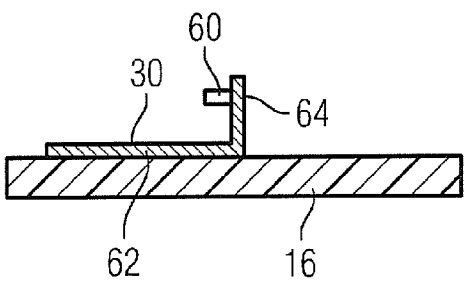
FIG 7B
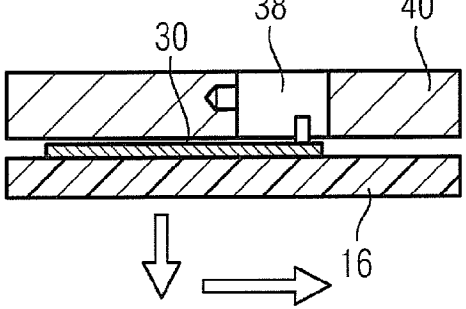
FIG 7C
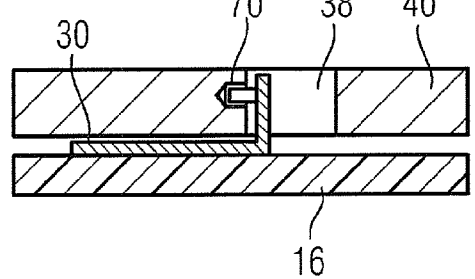

ARRANGEMENT FOR AXIALLY SECURING BLADES IN A ROTOR OF A GAS TURBINE

CROSS REFERENCE TO RELATED APPLICATIONS

This application is the US National Stage of International Application No. PCT/EP2009/050363, filed Jan. 14, 2009 and claims the benefit thereof. The International Application claims the benefits of European Patent Office application No. 08002388.0 EP filed Feb. 8, 2008. All of the applications are incorporated by reference herein in their entirety.

FIELD OF INVENTION

The invention refers to an arrangement for axially securing rotor blades in a rotor of a gas turbine according to the features of the claims.

BACKGROUND OF INVENTION

An arrangement of this type is known for example from WO 2007/028703 A1 and is illustrated here in FIGS. 1 and 2. The arrangement 10 comprises a shaft collar 21 which is formed by a rotor disk 19, which shaft collar 21 is part of the rotor 23 of a gas turbine. On the outer periphery 52 of the rotor 23, provision is made in the rotor disk 19 for grooves 12 which extend in the axial direction. Inserted in the grooves 12 are the roots 54 of the respective rotor blades 14 which are secured against displacement along the groove 12. For the securing, provision is made for so-called sealing elements 16 which at least partially cover the end-face opening of the respective groove 12 and which when assembled form an end-face sealing ring. On the end face 56 of the shaft collar 21, provision is made for an annular groove 20 in which the essentially rectangular sealing element 16 is seated. Radially on the outside, the sealing elements 16 lie in grooves 24 which are provided on the undersides 26 of the platforms 28 of the rotor blades 14. In order to secure the sealing elements 16 against displacement in the circumferential direction, at least one of the sealing elements 16 comprises a metal strip 30, which is fastened to this, with a leg 64, which leg 64 butts in a form-fitting manner either against the rotor blades 14 or their platforms 28 (FIG. 1), or against the rotor disk 19 itself (FIG. 2). In addition to securing the rotor blades 14, the sealing elements 16 also have the task of guiding a cooling air flow along the end face of the rotor disk 19.

During installation of the sealing elements and also during bending-in of the metal strip, these, however, can be incorrectly plastically deformed so that the sealing strip can sit in the annular groove with an excessively large clearance. As a result of this, cooling air losses can occur. Also, as a result of the plastic deformation which is not provided, the integrity of the sealing element and of the metal strip can be negatively influenced. Moreover, the slight spring-back of the metal strip after the bending-in process on account of its elasticity is disadvantageous.

SUMMARY OF INVENTION

The object of the invention is therefore the provision of an arrangement for axially securing rotor blades in a rotor of a gas turbine, in which the sealing elements can be installed and removed in a particularly reliable manner.

The solution provides that the material of the metal strip is a shape-memory alloy. By using the shape-memory alloy as the material for the metal strip, both the installation and the functional reliability of the metal strip can be enhanced. Moreover, it is provided that the metal strip butts against the sealing element in a clearance-free manner or under a pretension. As a result of this, an undesirable creeping of the sealing element in the circumferential direction can be reliably avoided. The reliable avoidance is attributed to the fact that a gap now no longer exists between sealing element and metal strip and therefore the metal strip is reliably locked by the machine component which butts against it, i.e. by the platform of the rotor blade or by the cam of the rotor disk. With the presence of a gap between sealing element and metal strip, in the worst case, depending upon its size, a relative movement between sealing element and machine component could occur, during which the machine component would slide into the gap. The last-mentioned, however, is prevented with the invention so that a particularly reliable securing of the sealing element against circumferential displacement can be achieved.

Components which are produced from shape-memory alloys are characterized in that as a result of temperature influence these can permanently alter their external shape, maintaining great rigidity. These components can therefore have a first geometry, i.e. shape and contour, and a second geometry. These components can be re-deformed from the second geometry into the first geometry by heat treatment alone. That geometry which the metal strip assumes after heat treatment has been carried out is subsequently also called the functional geometry. The second geometry can be almost any geometry and can be specified when producing the component.

The content which is described in publication WO 2007/028703 A1 is completely incorporated into this application by this reference. Particularly the arrangement according to FIG. 1 and FIG. 2 which is described in the prior art of WO 2007/028703 A1, and particularly the arrangements with reference to FIG. 3 and FIG. 4 according to the invention according to WO 2007/028703 A1, can be further improved by means of the invention which is described in this application.

The metal strip is produced in such a shape that in the installed state it shall later lock the position of the sealing elements. This preliminary shape corresponds to the first geometry. Before installation, the metal strip is then deformed in a suitable manner into the second geometry so that it can be fastened on the sealing element. The sealing element is then installed on the shaft collar. After installation, a temperature treatment is carried out, as a result of which the metal strip strives to re-deform itself into its first geometry. The temperature treatment can be carried out either by means of heating with the aid of an external source of heat just before putting the gas turbine into operation, or the initial operation of the gas turbine, during which high temperatures occur, can trigger the deformation of the metal strip. It is also possible for both temperature treatments to be applied in order to achieve a final deformation of the metal strip.

After the temperature treatment, the metal strip has assumed its functional geometry and secures the sealing element both against loss and against displacement in the circumferential direction. As long as functional geometry and first geometry differ from each other, a pretensioned fastening of sealing element or metal strip can be achieved.

In all, as a result of this an especially simple and secure installation of the metal strip or of the sealing element on the shaft collar of the rotor is made possible, as a result of which the disadvantages which occur in the prior art can be avoided. A manual bending-in of the metal strip therefore only needs to be carried out to a limited extent, or, in the best case, not at all.

Consequently, faulty manual installation can be excluded, which increases the reliability of the gas turbine which is equipped therewith.

In particular, if the leg butts against the rotor blades or against the shaft collar under a pretension, an especially reliable connection and fastening of the sealing element on the shaft collar or on the rotor can be made possible. The developments which are known from the prior art can preferably be further developed in this way. The pretension which is created by the metal strip according to the invention then acts specifically between rotor blade and sealing element so that the outer end of the sealing element which is seated in the groove, on account of the pretension, can be pressed flat against a sidewall of the groove which is arranged in the underside of the platform of the rotor blade. The flat pressing-on leads to a particularly tight abutment of the sealing element in the outer groove. Leakage of cooling air, which is directed by the sealing element, which could occur between the outer end of the sealing element and the groove, can consequently be reduced and in the best case avoided. The same applies to the inner end of the sealing element which is arranged in the annular groove radially on the inside if the metal strip is supported on the shaft collar in a pretensioned manner and in the process presses the inner end of the sealing element in a tight and flat manner against a sidewall of the annular groove.

Advantageous developments are disclosed in the dependent claims.

The material preferably has a one-way effect. This means that during heating up of the metal strip, which is pseudoplastically deformed in the martensitic state beforehand, a single change of shape takes place. The cooling down after heating has been carried out no longer brings about a change of shape. The metal strip remains in its first geometry or functional geometry.

It is also conceivable for a further component consisting of a non-shape-memory alloy to be attached on the metal strip in order to achieve an improved form fit for securing the sealing element.

BRIEF DESCRIPTION OF THE DRAWINGS

The invention is explained based on an exemplary embodiment which is represented in a drawing, wherein identical components are provided with the same designations. Further advantages and features result from the explanation.

FIGS. 3-7 show different further constructions of the fastening of the sealing element which is known from the prior art with a metal strip according to the invention consisting of a shape-memory alloy, in a purely schematic representation.

DETAILED DESCRIPTION OF INVENTION

Figure 1:
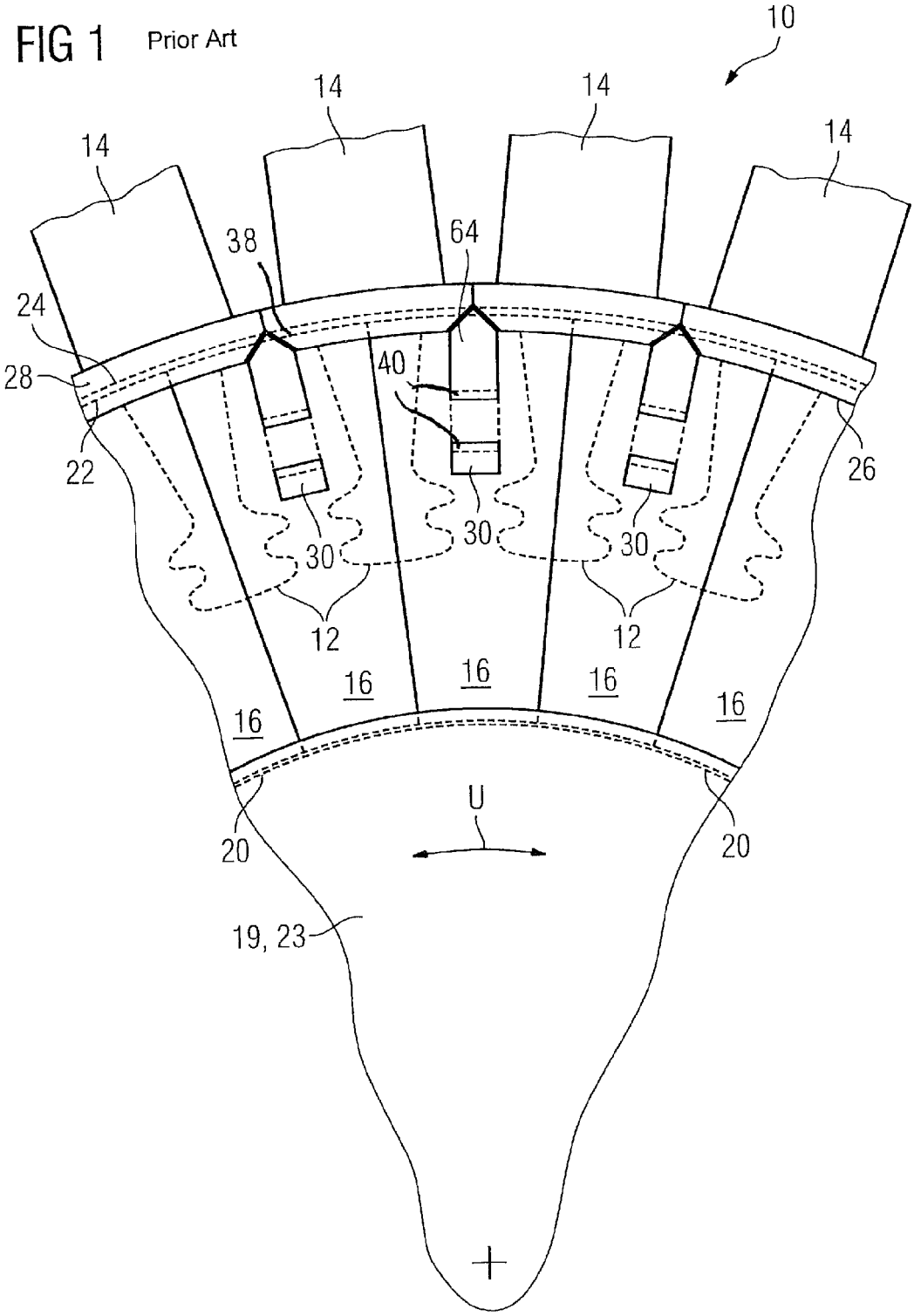
FIG 1 Prior Art
FIGS. 1, 2 show two arrangements of axial securing of rotor blades
Figure 2:
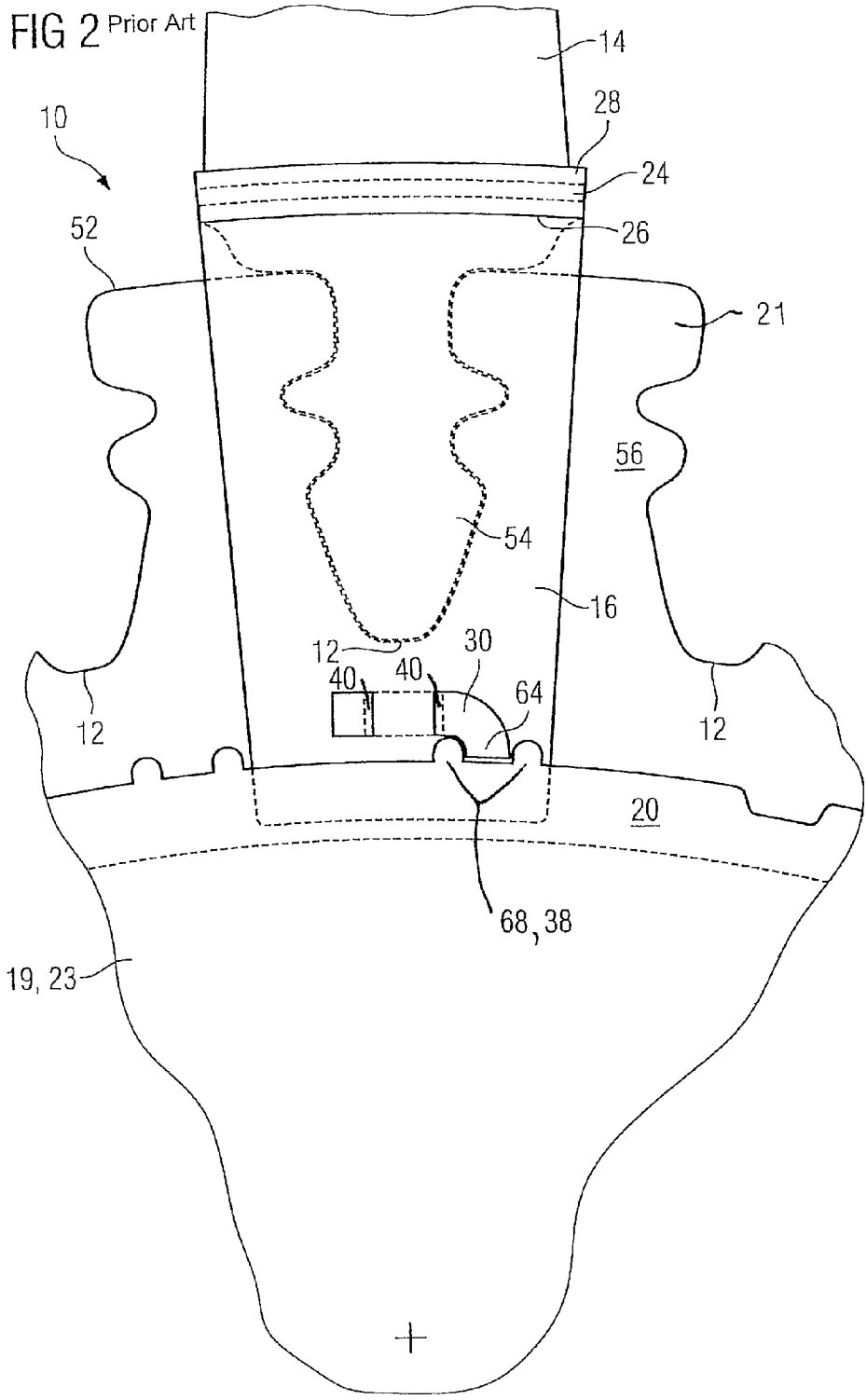
FIG 2 Prior Art

With reference to the description of FIG. 1 and FIG. 2 in the prior art, the metal strip 30, which is shown there, may be produced from a shape-memory alloy according to the invention. The geometry of the metal strip 30 which is shown in FIG. 1 and FIG. 2 represents the first geometry. For installing the metal strip 30, this is to be deformed into the second geometry beforehand so that the sealing element 16 can be inserted into an annular groove 20. After installation of the sealing element 16, the metal strip 30 can then be re-deformed into the functional geometry by means of heat treatment and can create the form fit between it and the platforms 28 (FIG. 1) or the rotor disk 19 (FIG. 2). As long as the functional geometry corresponds to the first geometry, the metal strip 30, and therefore the sealing element 16, is seated on the rotor 23 without tensioning or with clearance.

On the other hand, that configuration of the metal strip 30 which is formed according to the invention, which has a functional geometry which differs at least slightly from the first geometry in order to therefore create a pretension between rotor blade 14 or shaft collar 21 on one side and sealing element 16 on the other side, is especially preferable. A pretension is achieved if the first geometry of the metal strip 30 is selected so that despite the heat treatment this cannot be achieved on account of a mechanical blocking by other machine components. In this case, the metal strip 30 remains in the functional geometry after heat treatment has been carried out and in this case butts against the blocking machine component with pretension. The blocking machine component can be formed by the groove 24, the annular groove 20, the platform 28 of the rotor blade 14 or even by the shaft collar 21. As long as the functional geometry is selected so that a pretension which is directed perpendicularly to the plane of the drawing is created, the sealing element 16, radially on the outside, can be pressed flat with sealing effect onto the sidewall of the groove 24 which is arranged in the underside 26 of the platform 28, and/or, radially on the inside, pressed flat with sealing effect onto a sidewall of the annular groove 20, as a result of which a leakage of cooling air which is guided by the sealing element can be reduced and if necessary even avoided.

Instead of the configurations which are shown in FIG. 1 and FIG. 2, the invention can also be applied according to the invention with alternative configurations. For this purpose, different configurations with different metal strips 30 are shown in FIGS. 3 to 7. Common to all the metal strips 30 which are shown therein is that they are fastened in a suitable manner on a sealing element 16.

Each of FIGS. 3-7 includes three sub-figures which have either the suffix a, b or c. The sub-figures according to suffix a show the metal strip 30 according to the invention in its original geometry, i.e. first geometry, wherein the metal strip 30 is fastened on the sealing element 16 by suitable means, which are not additionally shown. The metal strips 30 are transferred into the second geometry by means of a pseudoplastic deformation. The sub-figures according to suffix b show the respective metal strip 30 which has the second geometry in the insertion or installation situation. In the sub-figures according to suffix c, the metal strips 30 are shown in each case in their functional geometry which they achieve after a single heating has been carried out and which they then permanently maintain with high rigidity. In the sub-figures according to suffixes b and c, a closure element 40 is additionally also shown in each case, with which the metal strip 30 can be brought into a form fit. For this purpose, the metal strip 30 is only to be subjected to heat treatment so that this strives to reach the first geometry from the second geometry. The closure element 40 can be optionally configured and in FIGS. 3-7 representatively is shown in an abstract manner either the pocket which is arranged on the shaft collar 21 or the tapering recess which is arranged between the platforms 26 of adjacent rotor blades 14.

With regard to FIGS. 3*a*, 3*b*, 3*c*, the metal strip 30 according to the invention, which consists of a shape-memory alloy for securing the sealing element 16 against displacement in the circumferential direction and which is fastened thereupon, has a first geometry which is L-shaped in cross section. Therefore, the metal strip comprises two legs 62, 64. One of the two legs of the metal strip, for example the leg 62, is fastened by suitable means on the sealing element 16. For example, the leg 62 of the metal strip 30 can be soldered to the sealing element 16. The other leg 64 then serves for the form-fit fastening of the sealing element 16 or of the metal strip 30 in a recess 38. The recess 38, as shown in FIG. 1, can also alternatively be arranged in a tapering manner between the platforms 28 of two directly adjacent rotor blades 14, or the recess 38 can be formed in this case by two teeth 68 which are arranged on the rotor disk 19 (FIG. 2).

FIG. 4 shows a configuration of the metal strip 30 which is an alternative to FIG. 3. Instead of a second leg 64, the metal strip 30 in the first geometry according to FIGS. 4*a*, 4*c* comprises a bead-like end 65 which can be transferred into a second geometry by means of pseudoplastic deformation. In the second geometry according to FIG. 4*b*, the end 65 is of a plate-like design, which facilitates the installation of the sealing element in the arrangement.

Common to the configurations according to FIG. 3 and FIG. 4 is that the functional geometry and the second geometry coincide and consequently the sealing element 16 can be fastened in the recess 38 with clearance.

FIG. 5 and FIG. 6 show configurations of a closure element 40 and of a metal strip 30, in which the geometry of the closure element 40 and the first geometry of the metal strip are selected so that a pretensioning force by the metal strip 30 can act upon the closure element. 40. By means of the pretensioning force, a clearance-free fastening of metal strip 30 or sealing element 16 on the closure element 40 is achieved. In order to achieve this, the functional geometry differs from the first geometry. The achieving of the first geometry of the metal strip 30, consisting of the shape-memory alloy, during subsequent heat treatment is prevented on account of the selected shape of the closure element 40 by the complete re-deformation of the metal strip 30 being blocked at least to a small extent by means of the closure element 40. As a result of this, a clearance-free and pretensioned fastening of sealing element 16 and closure element 40 can be achieved. As a result, the configuration according to FIG. 5 differs from FIG. 3 only in shape and contour of the closure element.

FIG. 7 shows a further developed construction according to FIG. 3. On the "movable" second leg 64, a further element 60 consisting of a non-shape-memory alloy is fastened. The element 60 in this case can be designed in the form of a spigot. After heat treatment has been carried out, the element 60 is located in a recess 70, as a result of which the metal strip 30 or the sealing element 16 is locked in a form-fitting manner against a movement in relation to the closure element 40.

Common to all the exemplary embodiments is that as a result of using a shape-memory alloy as the material of the metal strip, a particularly reliable installation of the sealing element can be achieved without undesirable damage of the sealing element being able to occur on account of manual bending processes. Furthermore, as a result of components which are cleverly matched to each other a pretensioned fastening of the sealing element on the rotor can be achieved, which reduces leakage of cooling air as a result of the otherwise existing clearance-flawed seating of the sealing element in the groove.

In all, with the invention an arrangement for axially securing rotor blades of a rotor of a gas turbine is disclosed, which comprises a sealing element which is arranged on the end face of the rotor and which by means of a metal strip consisting of a shape-memory alloy can be fastened in a particularly reliable manner.

The invention claimed is:

1. An arrangement for axially securing rotor blades in a rotor, comprising:

a rotor;

a plurality of rotor blades;

a shaft collar, where a plurality of rotor blade retaining grooves are disposed on an outer periphery of the shaft collar, the plurality of rotor blade retaining grooves extend in an axial direction of the rotor and in which the plurality of rotor blades are arranged in each case with a plurality of blade roots which correspond to the rotor blade retaining groove;

a radially outwardly open, encompassing groove which is arranged on an end face of the shaft collar in a region of the plurality of rotor blade retaining grooves; and a plurality of metal-like sealing elements, wherein for axially securing the plurality of rotor blades, the plurality of sheet metal-like sealing elements are seated in the encompassing groove in each case and in a circumferential direction form an end-face sealing ring, wherein for securing the plurality of sealing elements against displacement in the circumferential direction at least one of the sealing elements comprises a metal strip which includes a first geometry representing a preliminary shape, which is then fastened upon a sealing element, the metal strip including a leg which butts against the plurality of rotor blades or against the shaft collar in a form-fitting manner, wherein a material of the metal strip is a shape-memory alloy, and wherein the leg of the metal strip, after thermal treatment has been carried out, butts against the plurality of rotor blades or against the shaft collar under a pretension whereby the metal strip assumes a functional geometry which is at least slightly different from the first geometry using a selected shape of a closure element to block the metal strip from complete redeformation to the first geometry, and in the process presses the sealing element flat against a sidewall of a groove or the annular groove.

2. The arrangement as claimed in claim 1, wherein the material has a one-way effect, whereby the metal strip changes shape during the thermal treatment only.

3. An arrangement for axially securing rotor blades in a rotor, comprising:

a rotor;

a plurality of rotor blades;

a shaft collar, where a plurality of rotor blade retaining grooves are disposed on an outer periphery of the shaft collar, the plurality of rotor blade retaining grooves extend in an axial direction of the rotor and in which the plurality of rotor blades are arranged in each case with a plurality of blade roots which correspond to the rotor blade retaining groove;

a radially outwardly open, encompassing groove which is arranged on an end face of the shaft collar in a region of the plurality of rotor blade retaining grooves: and a plurality of metal -like sealing elements.

wherein for axially securing the plurality of rotor blades, the plurality of sheet metal-like sealing elements are seated in the encompassing groove in each case and in a circumferential direction form an end-face sealing ring, wherein for securing the plurality of sealing elements against displacement in the circumferential direction at least one of the sealing elements comprises a metal strip, which is fastened upon a sealing element, the metal strip including a leg which butts against the plurality of rotor blades or against the shaft collar in a form-fitting manner, wherein a material of the metal strip is a shape-memory alloy, and wherein the leg of the metal strip, after thermal treatment has been carried out, butts against the plurality of rotor blades or against the shaft collar under a pretension, and in the process presses the sealing element against a side-wall of a groove or the encompassing groove wherein a further element consisting of a non-shape-memory alloy is attached on the metal strip.

* * * * *